US009334080B2

(12) United States Patent
Yamamoto

(10) Patent No.: US 9,334,080 B2
(45) Date of Patent: May 10, 2016

(54) DISPLAY-CUM-PACKAGING BOX

(71) Applicant: Shigetaka Yamamoto, Osaka (JP)

(72) Inventor: Shigetaka Yamamoto, Osaka (JP)

(73) Assignee: KOBAYASHI PHARMACEUTICAL CO., LTD., Osaka (JP)

( * ) Notice: Subject to any disclaimer, the term of this patent is extended or adjusted under 35 U.S.C. 154(b) by 447 days.

(21) Appl. No.: 13/724,552

(22) Filed: Dec. 21, 2012

(65) Prior Publication Data

US 2013/0180883 A1 Jul. 18, 2013

Related U.S. Application Data

(63) Continuation of application No. PCT/JP2011/064418, filed on Jun. 23, 2011.

(30) Foreign Application Priority Data

Jun. 23, 2010 (JP) ..... 2010-142356

(51) Int. Cl.

| | |
|---|---|
| ***B65D 5/52*** | (2006.01) |
| ***B65D 71/36*** | (2006.01) |
| ***B65D 5/48*** | (2006.01) |
| ***B65D 5/66*** | (2006.01) |

(52) U.S. Cl.

CPC ..... *B65D 5/5266* (2013.01); *B65D 5/48018* (2013.01); *B65D 5/6626* (2013.01); *B65D 71/36* (2013.01); *B65D 2571/0066* (2013.01); *B65D 2571/00141* (2013.01); *B65D 2571/00561* (2013.01); *B65D 2571/00728* (2013.01)

(58) Field of Classification Search

USPC ..... 206/738, 739, 745, 746, 756

See application file for complete search history.

(56) References Cited

U.S. PATENT DOCUMENTS

| | | | | |
|---|---|---|---|---|
| 6,135,289 | A * | 10/2000 | Miller | 206/774 |
| 6,311,845 | B1 | 11/2001 | Uren et al. | |
| 6,484,903 | B2 * | 11/2002 | Spivey et al. | 221/303 |

(Continued)

FOREIGN PATENT DOCUMENTS

| | | | |
|---|---|---|---|
| EP | 1613537 | B1 | 1/2006 |
| JP | 0637122 | U | 5/1994 |

(Continued)

OTHER PUBLICATIONS

Decision of Allowance Application No. 2010142356 Dispatch Date: Feb. 24, 2015 pp. 5.

(Continued)

*Primary Examiner* — Jacob K Ackun

(74) *Attorney, Agent, or Firm* — St. Onge Steward Johnston & Reens, LLC

(57) ABSTRACT

A box that has enhanced product package storing efficiency and that can display product packages stored inside. The box includes a box body and a cover that can open and close the upper surface opening of the box body. The box body has a front plate, a back plate, right and left side plate, a bottom plate that has a rectangular shape, and a storage space for a plurality of product packages arranged on both upper and lower levels by placing, on each product package that has been placed on the bottom plate, another product package. The front plate is capable of being tear-opened to form an opening that makes the stored product packages visible, and the opening is provided with a fall preventer that supports the front-most product package on the upper level and prevents it from falling from the opening.

5 Claims, 9 Drawing Sheets

(56) References Cited

U.S. PATENT DOCUMENTS

| | | | | |
|---|---|---|---|---|
| 6,554,135 | B1 * | 4/2003 | Luceri et al. | 206/526 |
| 2004/0188277 | A1 | 9/2004 | Auclair | |
| 2005/0189405 | A1 | 9/2005 | Gomes et al. | |
| 2013/0075302 | A1 * | 3/2013 | Bucknell | 206/765 |

FOREIGN PATENT DOCUMENTS

| | | | |
|---|---|---|---|
| JP | 2599790 | Y2 | 9/1999 |
| JP | 2001354237 | A | 12/2001 |
| JP | 2003512981 | A | 4/2003 |
| JP | 2004182345 | A | 7/2004 |
| JP | 2006521253 | A | 9/2006 |
| JP | 2007525387 | A | 9/2007 |
| JP | 4253545 | B2 | 4/2009 |
| WO | 0132518 | A1 | 5/2001 |
| WO | 2004087522 | A1 | 10/2004 |
| WO | 2005092735 | A2 | 10/2005 |

OTHER PUBLICATIONS

Decision of Rejection Application No. 2010142356 Dispatch Date: Oct. 14, 2014 pp. 6.

Notification of Reason for Rejection Application No. 2010142356 Dispatch Date: Mar. 4, 2014 pp. 6.

International Search Report Application No. PCT/JP2011/064418 Completed: Sep. 9, 2011; Mailing Date: Sep. 20, 2011 2 pages.

* cited by examiner

DISPLAY-CUM-PACKAGING BOX

FIELD OF THE INVENTION

The present invention relates to a display and packaging box for storing and delivering product packages having a product accommodating part that accommodates a product and a header part provided adjacent thereto. The display and packaging box can also display the stored product packages in situ at the store where the packages are delivered.

BACKGROUND OF THE INVENTION

A display and packaging box that is capable of displaying products in situ without needing to take the products out of the packaging box and that is used for delivery is known. As an example of this type of display and packaging box, a box has been proposed that is made of cardboard or thick paper and that is configured such that a cut line for opening the packaging box is carved entirely around the body of the box. The box is then cut along this cut line, the upper half of the box is removed, and the lower half is used as a tray in situ, thus displaying the product packages arranged inside the box (see, for example, Patent Literature 1).

For display at a store front, it is common that packaging boxes are piled up into several levels. With the display and packaging box described in Patent Literature 1, where the upper half of the top packaging box can be removed and the lower half used as a tray, the packaging boxes below the top box can be piled up while making the product packages inside visible through an opening by tearing along the perforations provided in the front part of the body of each box to form a window-like opening.

However, in the display and packaging box described in the Patent Literature 1, stored product packages are arranged into a single line, thus creating an unused space in the upper part of the product accommodating part inside the packaging box, and resulting in a packaging box with a poor product package storage efficiency.

In this regard, a packaging box has been proposed in which product packages arranged sideways are placed such that a pair of product accommodating parts face each other (see, for example, Patent Literature 2). With the display and packaging box described in Patent Literature 2, the packaging box is cut along the cut line provided in the central portion of the packaging box, and then the packaging box is opened in a clamshell door-like manner. Thus, a plurality of product packages accommodated in the halved packaging box that has been divided into right and left portions by being opened reach an upright state, and as a result, installing these portions makes it possible to display the product packages.

CITATION LIST

Patent Literature

Patent Literature 1: Japanese Utility model Registration No. 2599790

Patent Literature 2: Japanese Patent No. 4253545

SUMMARY OF THE INVENTION

Technical Problem

With the display and packaging box described in Patent Literature 2, although it is possible to achieve an enhanced product package storage efficiency because the unused space in the packaging box is reduced, arranging the product packages on top of one another for display makes them unstable, making it impossible to stack up the product packages. Therefore, when packaging boxes are stacked into multiple levels, only the packaging box on the upper-most level is opened, and the packaging boxes below the top cannot be opened to display the product packages accommodated therein, resulting in a mere pile of packaging boxes. This is problematic in that such packaging boxes when placed at the store front do not offer an attractive display to customers.

The present invention has been conceived in view of the foregoing problems, and an object of the present invention is to provide a display and packaging box that has an enhanced product package storing efficiency and that can display product packages stored inside even when the box is stacked on a lower level.

Solution to Problem

The aforementioned object can be achieved by a display and packaging box that stores a plurality of product packages constituted by a header part and a product accommodating part that accommodates a product, including a box body at least having a front plate part and a back plate part that face each other, right and left side plate parts that face each other, a bottom plate part that has a rectangular shape when viewed from above and on which a predetermined number of the product packages are placed upright in a front-back direction, and a storage space that can store the product packages arranged on both upper and lower levels by placing, on the product accommodating part of each product package that has been placed on the bottom plate part, the product accommodating part of another product package, the front plate part being formed such that at least part of the front plate part can be tear-opened, the tear-opened front plate part forming an opening that makes the stored product packages visible, and the opening being provided with a fall prevention means that supports the front-most product package on the upper level and prevents the product package from falling from the opening.

In a preferable embodiment of the present invention, the box body has an opening in an upper surface, and the upper surface opening can be opened and closed by a cover.

In a preferable embodiment of the present invention, the product accommodating part of the product package has an upper surface provided with a curved portion that curves down toward a front such that the product package located on the upper level can slide forward on the product accommodating part of the product package located on the lower level.

In a more preferable embodiment of the present invention, the product accommodating part of the product package has an upper surface that includes a flat portion and the curved portion that is continuous with the flat portion, the product package located on the upper level is arranged on the product accommodating part of the product package located on the lower level such that a centre of gravity thereof is placed more towards the front than a central position of the flat portion.

In another preferable embodiment of the present invention, the product accommodating part of the product package has an upper surface formed into a convex surface, and the product package located on the upper level is arranged on the product accommodating part of the product package located on the lower level such that a centre of gravity thereof is placed more towards the front than an apex of the upper surface of the product accommodating part.

In a more preferable embodiment of the present invention, the fall prevention means is composed of a remaining part of the front plate part formed by tear-opening part of the front plate part.

In a more preferable embodiment of the present invention, the remaining part of the front plate part is formed by separating a predetermined region below an upper edge of the front plate part.

In another more preferable embodiment of the present invention, a notch part that a tip part of a lower surface of the product accommodating part of the front-most product package on the upper level can enter is formed on an upper edge of the remaining part of the front plate part.

In another more preferable embodiment of the present invention, the remaining part of the front plate part is formed by partially separating the front plate part so as to leave predetermined regions on both sides of the front plate part.

In another more preferable embodiment of the present invention, the fall prevention means is composed of a pair of support pieces formed by cutting part of the side plate parts, and the support pieces are folded towards the opening side and brought into contact with the front-most product package on the upper level to support the product package.

Advantageous Effects of Invention

With the display and packaging box of the present invention, the product package storing efficiency can be enhanced, and not only the product packages stored inside the packaging box on the upper-most level can be displayed, but also those inside the packaging boxes placed on lower levels.

DETAILED DESCRIPTION OF THE INVENTION

Figure 1:
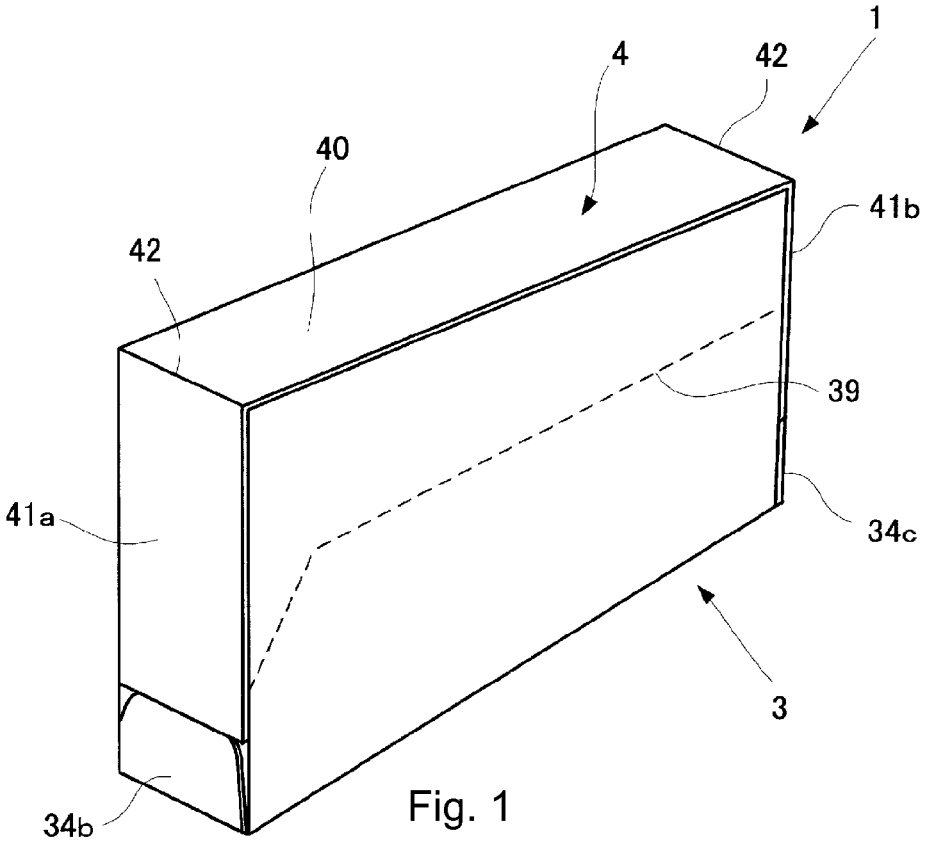
FIG. 1 is a perspective view showing an appearance of a display and packaging box of one embodiment of the present invention.
Figure 2:
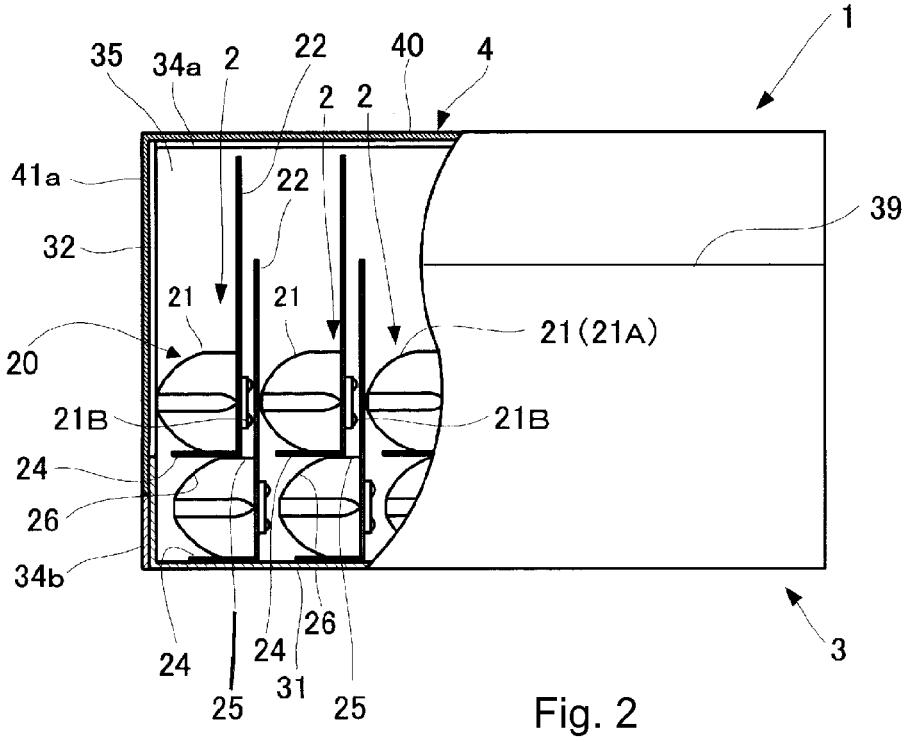
FIG. 2 is a cross-sectional view of the display and packaging box of FIG. 1.

Embodiments of the present invention will now be described below with reference to the attached drawings. FIG. 1 shows an appearance configuration of a display and packaging box 1 that is one embodiment of the present invention, and FIG. 2 shows an internal configuration of the display and packaging box 1 of FIG. 1. The display and packaging box 1 shown in the figures functions as a packaging box that can store and carry a plurality of product packages 2, and also functions as a display box that can display at the store front the stored product packages 2 in situ without taking the product packages 2 out of the packaging box.

This display and packaging box 1 is composed of a paper material such as cardboard, and is configured with a box body 3 that has an opening 30 in the upper surface and a detachable cover 4 which covers the upper surface opening 30 of the box body 3.

Figure 3:
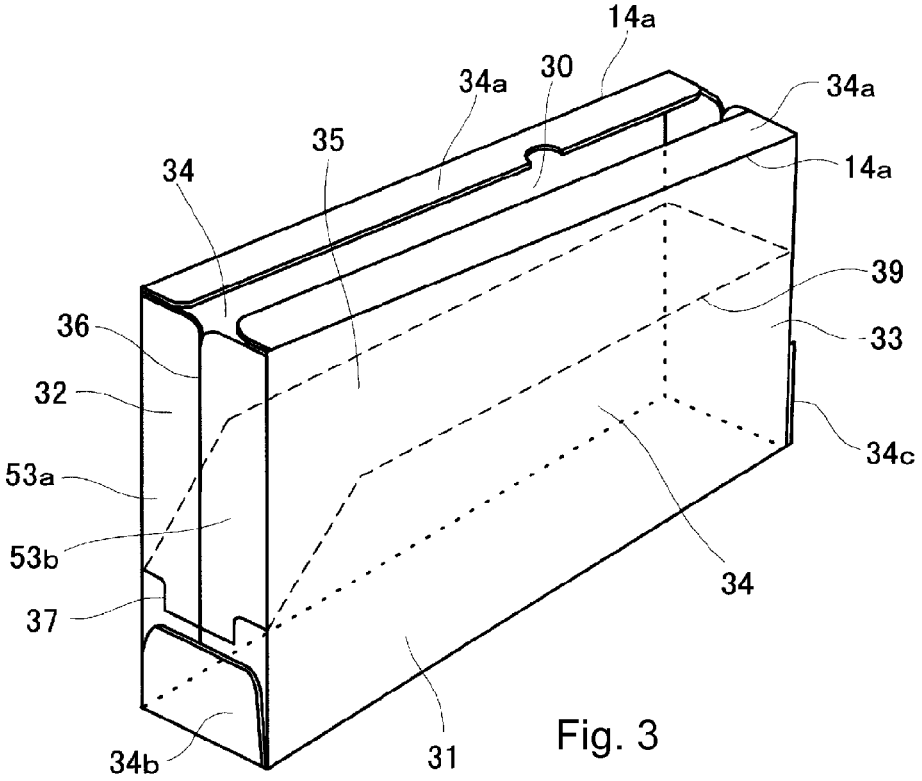
FIG. 3 is a perspective view of a box body.
Figure 4:
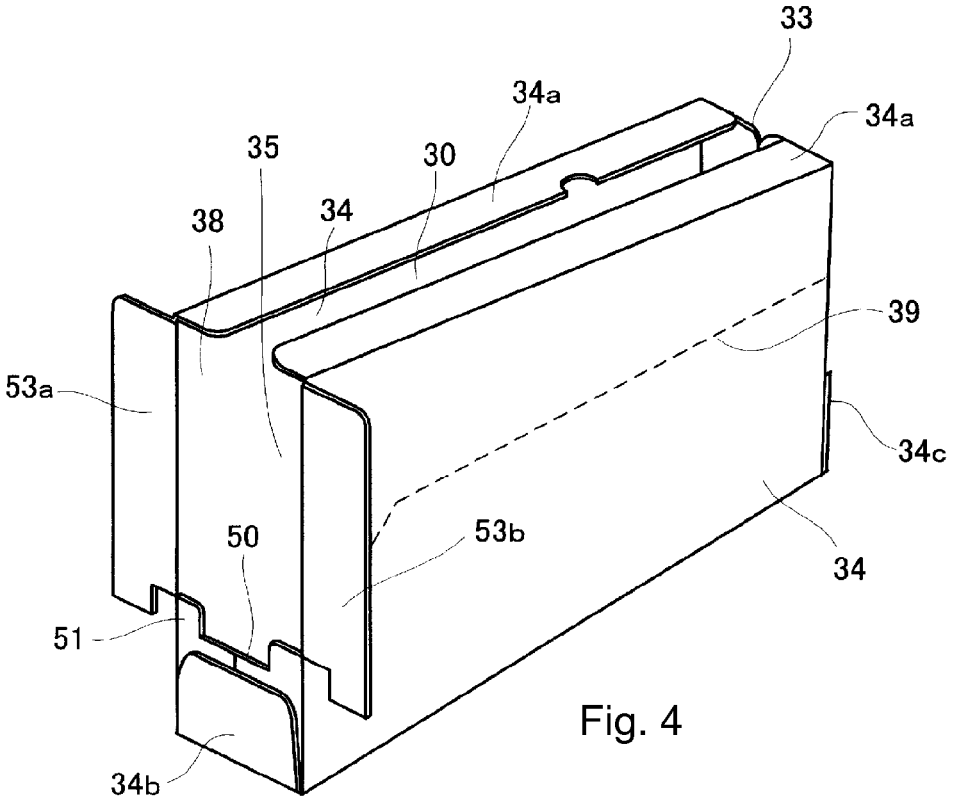
FIG. 4 is a perspective view showing the box body, a front plate part of which is tear-opened.

The box body 3 is, as shown in FIGS. 3 and 4, a box-shaped container provided integrally with a rectangular bottom plate part 31, a front plate part 32 and a back plate part 33 that face each other, and a pair of right and left side plate parts 34 and 34 that face each other. The upper surface of the box body 3 has an opening, and it is also possible to take out the product packages 2 from this upper surface opening 30. The space enclosed by the bottom plate part 31, the front plate part 32, the back plate part 33, and both side plates 34 is a storage space 35 for storing the product packages 2. In the display and packaging box 1 according to the present invention, the product packages 2 are arranged in the front-back direction on both upper and lower levels in the storage space 35 of the box body 3.

Figure 8:
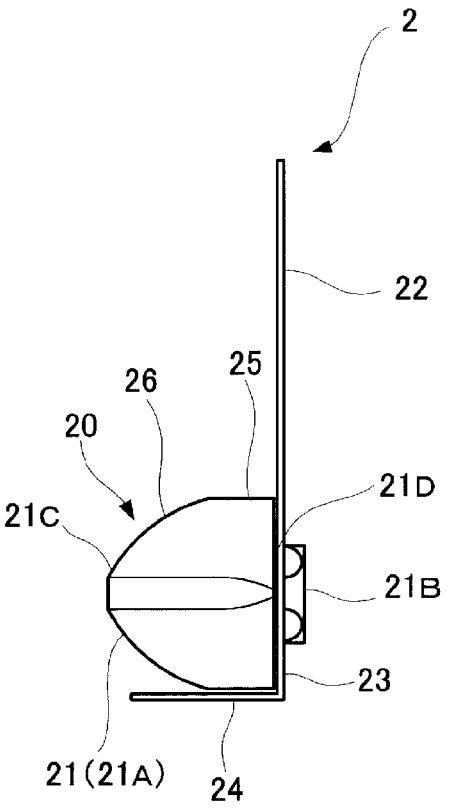
FIG. 8 is a side view of the product package.

As shown in FIG. 8, the product package 2 is configured so as to be provided with a header part 22 adjacent to a product accommodating part 20 that accommodates a product 21, and has a shape in which the product accommodating part 20 projects outward relative to one surface of the header part 22. With the product accommodating part 20 of another product package 2 being placed on that product accommodating part 20, a plurality of product packages 2 are arranged on the bottom plate part 31 of the box body 3, thus making it possible to store a plurality of product packages 2 on both the upper and lower levels. In this embodiment, this product package 2 is configured such that the product 21 is integrally packaged with a substantially rectangular paper mount 23 made of a pasteboard material by wrapping them with a cylindrical resin film such as shrink film (not shown).

In this embodiment, a container 21A filled inside with a medical fluid, cosmetic, flavoring agent, drinking water, or a similar content is used for the product 21. This container 21A has a neck 21D that is constricted between a head 21B and a body 21C in which the content is kept. This neck 21D is fitted to a container retaining hole (not shown) formed in the paper mount 23, and thus the container 21A is supported by the paper mount 23 while lying on its side.

At the lower end part of the paper mount 23, a support piece 24 is integrally provided in a continuous manner. This support piece 24 is configured so as to be capable of being folded towards the front side along a folding line (not shown), and making the support piece 24 level to bring it into contact with the lower side surface of the container 21A that is supported while lying on its side allows the product package 2 to be placed upright on the bottom plate part 31 of the box body 3.

In the product package 2 having the above-described configuration, the portion where the container 21A is wrapped by resin film and supported by the paper mount 23 constitutes the product accommodating part 20, and the portion of the paper mount 23 projecting above the container 21A constitutes the header part 22, but the product package 2 is not limited to the above-described configuration. Product packages with various configurations can be expected as long as the product accommodating part 20 that accommodates the product projects outward relative to the header part 22, such as a blister-pack product package for which a product is packaged after being placed on a paper mount and then covered from above with a transparent plastic cover having a depressed part that can store the product, a product package that takes a form in which a product is packaged inside a box that has a header part, and the like.

A plurality of product packages 2 having the above-described configuration are arranged on the bottom plate part 31 of the box body 3 such that the product accommodating parts 20 (container portions) project in the same direction, and then the product accommodating parts 20 (container portions) of other new product packages 2 are placed on the product accommodating parts 20 (container portions) of the product packages 2 that have been arranged on the bottom plate part 31 such that the product accommodating part 20 is sandwiched between the header parts 22 of the product packages 2 in front and behind on the lower level. Accordingly, a plurality of product packages 2 are stored in the box body 3 while maintaining both the upper and lower levels (see FIG. 2). Note that the front-most product package 2 on the upper level is stored while being sandwiched between the front plate part 32 of the box body 3 and the header part 22 of the product package 2 that is located immediately behind on the lower level. In this storage state, the size of the box body 3 is suitably set such that a small space is provided between both edges of the paper mount 23 of each product package 2 and the side plate parts 34 of the box body 3 to such an extent that the product packages 2 do not rattle, and a small space is provided also between the upper edge of the paper mount 23 of each product package 2 on the upper level and a flap 34*a* of the box body 3, so that an external shock is not directly transmitted to the product packages 2.

As shown in FIG. 8, in this embodiment, in addition to a flat portion 25 for receiving the product accommodating part 20 of the product package 2 placed on the upper level, a curved portion 26 that curves down towards the front from the flat portion 25 is formed on the upper surface of the product accommodating part 20 (the upper side surface of the container 2 in this embodiment). As shown in FIG. 2, the product package 2 on the upper level is placed on the product accommodating part 20 (container portion) of the product package 2 on the lower level such that the position of the centre of gravity thereof is placed more towards the front than the central position of the flat portion 25. Accordingly, when the product packages 2 are stacked in a natural manner, the product package 2 placed on the upper level slides towards the front on the product accommodating part 20 (container portion) of the product package 2 placed on the lower level via the curved portion 26. In this embodiment, the head 21B of the container 21A projecting from the paper mount 23 of the product package 2 located on the upper level comes into contact with the header part 22 of the product package 2 located on the lower level, and thus the position of the centre of gravity thereof is more towards the front than the central position of the flat portion 25.

When the product packages 2 are stacked on both the upper and lower levels in the box body 3, the product package 2 located on the upper level is prevented from sliding down towards the front by the header part 22 of the product package 2 on the lower level that is located immediately in front and that serves as a stopper, and is thus retained on the upper level position. On the other hand, when the product package 2 on the lower level that is located immediately in front is removed, the product package 2 located on the upper level naturally slides down towards the front because the aforementioned stopper is gone, and falls on the bottom plate part 31 of the box body 3. At this time, the product accommodating part 20 lands upright on the bottom plate part 31 of the box body 3 because the support piece 24 provided on the lower surface of the product accommodating part 20 is formed so as to have a flat surface. Accordingly, in this embodiment, when the product package 2 on the lower level that is located immediately in front is removed, the product package 2 located on the upper level naturally falls on the bottom part 31 of the box body 3, and is placed little closer to the front in the box body 3, thereby making it easy to also take out from the box body 3 the product packages 2 stored towards the back and easy to see the product packages 2 remaining in the box body 3, and thus more effective product display can be achieved.

Referring back to FIGS. 1 and 2, the cover 4 includes a top panel part 40 with a size that allows the upper surface opening 30 of the box body 3 to be closed, and on the shorter sides of the top panel part 40, side surface parts 41*a* and 41*b* are respectively provided in a continuous manner via creases 42. The side surface parts 41*a* and 41*b* partially cover the front plate part 32 and the back plate part 33 of the box body 3, respectively, and reinforce these parts. Note that the cover 4 does not necessarily need to be separate from the box body 3, and may be formed integrally with the box body 3 so as to be capable of opening and closing the upper surface opening 30.

As shown in FIGS. 3 and 4, flaps 34*a* and 34*a* are formed integrally with the box body 3 at the upper edges of the respective side plate parts 34. The respective flaps 34*a* are formed so as to be foldable along the creases 14*a* and 14*a*, and serve as attachment surfaces to which the top panel part 40 of the cover 4 is attached with, for example, glue.

The front plate part 32 is provided with a tear-opening assisting line 36 extending downward from the upper edge in the substantially central position relative to both side edges so as to allow the front plate part 32 to be tear-opened. In this embodiment, the tear-opening assisting line 36, which will be described below in detail, is formed by a junction created by joining the edge faces of two slat parts 32*a* and 32*b* that constitute the front plate part 32. Note that the configuration of the tear-opening assisting line 36 is not limited to that of this embodiment, and for example, the tear-opening assisting line 36 may be formed by providing a cut line that extends downward from the upper edge in the substantially central position relative to both side edges of the front plate part 32. Also, a lateral cut line 37 that extends perpendicular to the tear-opening assisting line 36 is formed in the lower part of the front plate part 32. In this embodiment, this lateral cut line 37 is formed into such a shape that the central part is depressed downward and has a level difference.

Part of the front plate part 32 is tear-opened along this tear-opening assisting line 36 and lateral cut line 37, then a pair of tear-open plate parts 53*a* and 53*b* formed by this tear-opening are opened in a clamshell door-like manner along the respective edges of the front plate part 32, and thereby the opening 38 is formed in the front surface of the box body 3 as shown in FIG. 4. The product packages 2 stored in the box body 3 are exposed through this opening 38 and thus can be displayed.

Also, the side plate parts 34 and the back plate part 33 are provided with a cut line 39 that continues from the lateral cut line 37 of the front plate part 32. In this embodiment, this cut line 39 gradually ascends towards the back from the place of connection with the cut line 37 of the front plate part 32, and then stays flat and extends to the back plate part 33. The lateral cut line 37 of the front plate part 32 and the cut line 39 of the side plate parts 34 and the back plate part 33 enable the upper part of the box body 3 to be separated. Accordingly, the product packages 2 stored inside the box body 3 are further exposed, thus making it possible to more effectively display the product packages 2 and smoothly take out the product packages 2 from above.

The shape of the cut line 39 is not limited to that of this embodiment, and may have such a shape that the cut line 39 horizontally extends from the place of connection with the lateral cut line 37 of the front plate part 32 to the back plate part 33, may have such a shape that the cut line 39 ascends obliquely upward from the place of connection with the lateral cut line 37 of the front plate part 32 to the back plate part 33, or may have various other shapes. Also, the cut line 39 does not necessarily need to continue from the lateral cut line 37 of the front plate part 32.

Figure 6:
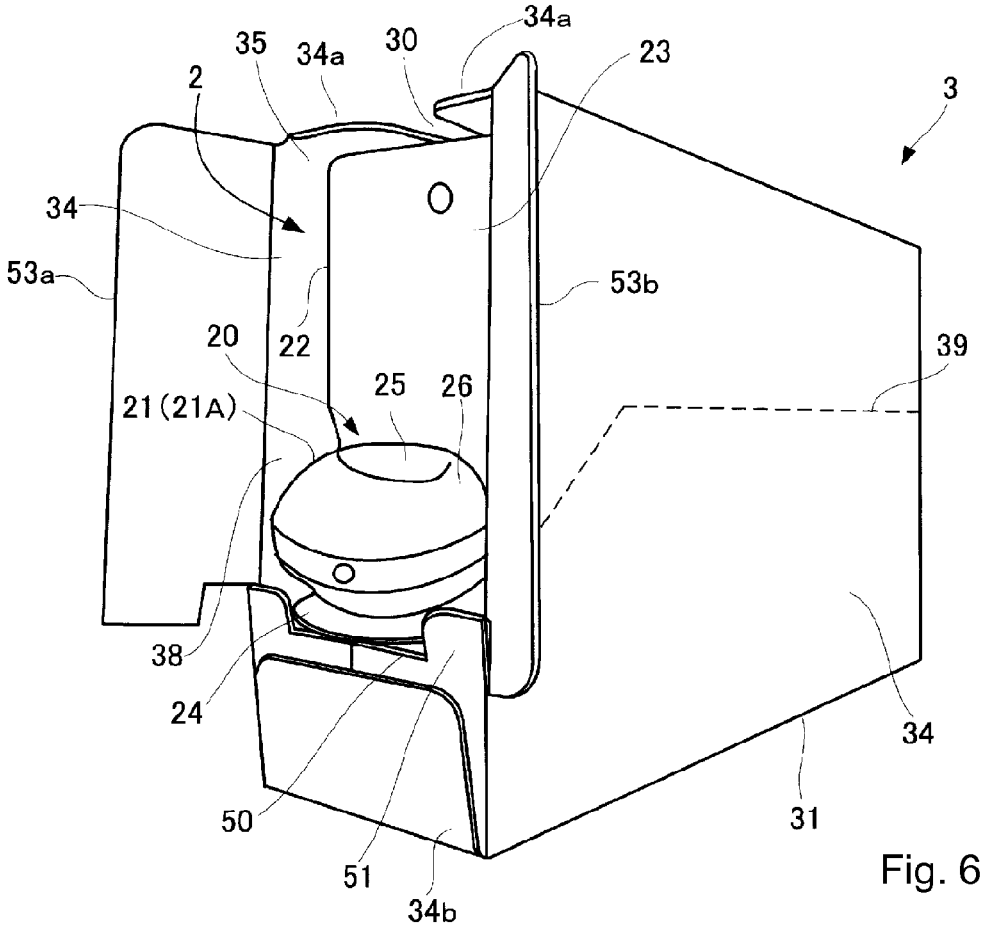
FIG. 6 is a perspective view showing the box body, the front plate part of which is tear-opened, and in which a product package is stored.
Figure 7:
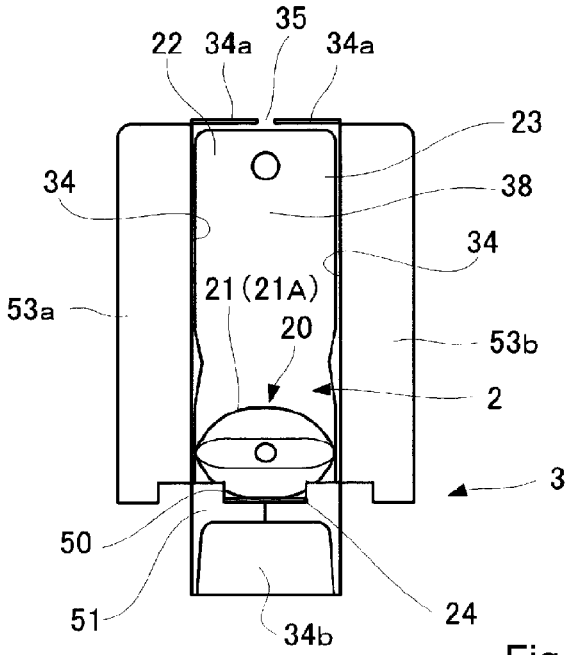
FIG. 7 is a front view showing the box body, the front plate part of which is tear-opened, and in which a product package is stored.

With part of the front plate part 32 being tear-opened, the tear-open plate parts 53*a* and 53*b* are separated from the front plate part 32, and therefore a remaining part 51 of the front plate part 32 that has a notch part 50 notched into a U shape in the center of the upper edge is formed on the front surface of the box body 3. The size of the remaining part 51 of the front plate part 32 is configured such that the bottom part of the notch part 50 is positioned at the substantially same height as the lower surface (the support piece 24 in this embodiment) of the product accommodating part 20 of the front-most product package 2 arranged on the upper level in the box body 3. When part of the front plate part 32 is tear-opened and the product package 2 in the box body 3 is exposed, as shown in FIGS. 6 and 7, the tapered tip portion of the support piece 24 enters and fits in the notch part 50 of the remaining part 51 of the front plate part 32, and the front-most product package 2 on the upper level is blocked by the remaining part 51 of the front plate part 32, thereby being prevented from leaning forward and rising over the remaining part 51 of the front plate part 32 and falling outward from the opening 38.

In this way, with the display and packaging box 1 of this embodiment, tear-opening part of the front plate part 32 makes it possible to display the product packages 2 stored inside, and retaining the remaining part 51 of the front plate part 32 so as to be capable of supporting the product accommodating part 20 of the front-most product package 2 on the upper level allows the remaining part 51 to function as a fall prevention means that prevents the product package 2 from falling outward from the opening 38.

Figure 5:
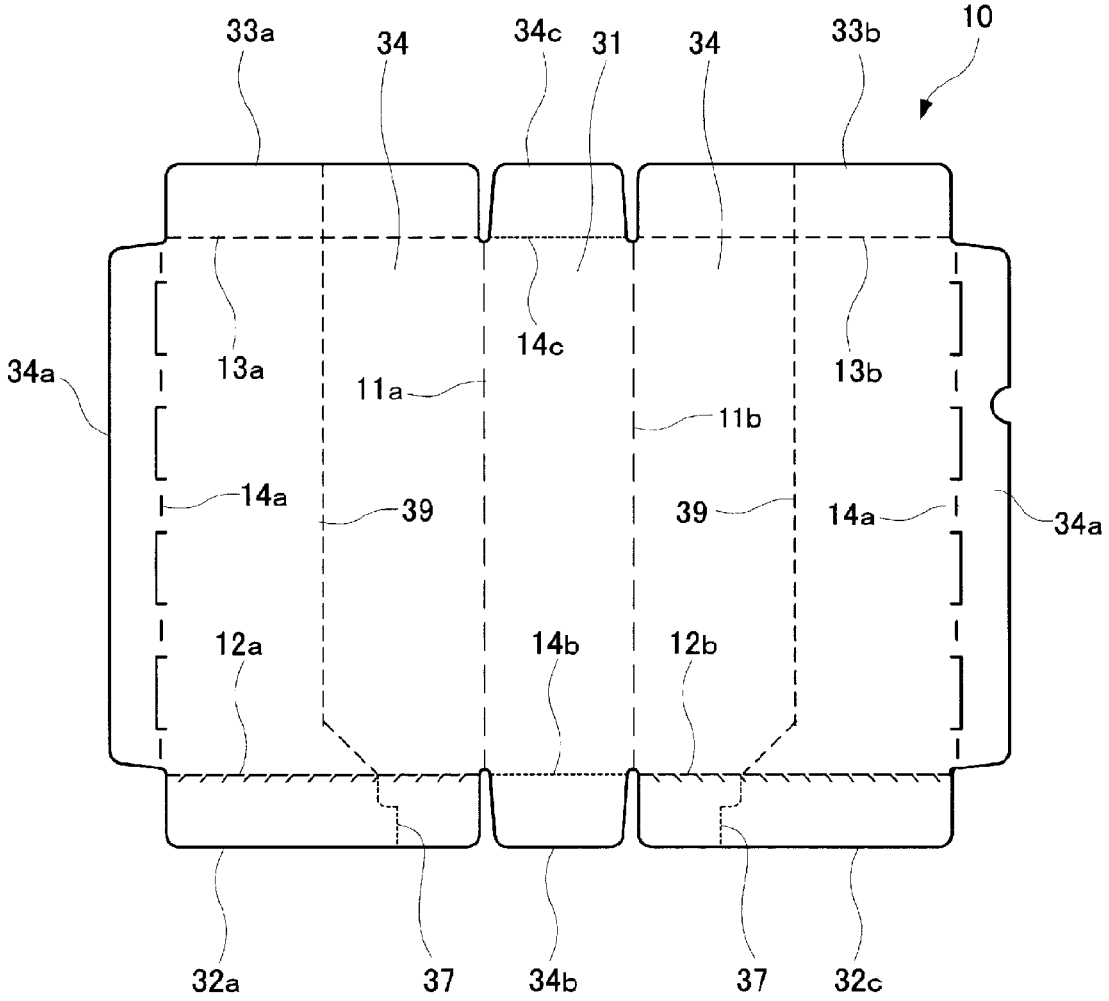
FIG. 5 is a plan view of a pattern paper that forms the box body.

The box body 3 having the above-described configuration is assembled by folding, for example, a pattern paper 10 as shown in FIG. 5 that is made of a piece of cardboard with a predetermined thickness along predetermined creases. Note that the box body 3 is made of cardboard in this embodiment, but the box body 3 is not limited thereto and may be made of various materials.

The pattern paper 10 for assembly of the box body 3 has the rectangular bottom plate part 31 in the center, and the side plate parts 34 are provided in a continuous manner on the longer-side sides of the bottom plate part 31 via the respective creases 11*a* and 11*b*. On the shorter-side sides of the side plate parts 34, the slat parts 32*a* and 32*b* as well as 33*a* and 33*b* that constitute the front plate part 32 and the back plate part 33 are formed in a continuous manner via creases 12*a*, 12*b*, 13*a*, and 13*b*. Flaps 34*b* and 34*c* are provided on the respective edges of the bottom plate part 31 and the flaps 34*a* and 34*a* are provided on the respective side plate parts 34 via creases 14*a* to 14*c*. Each crease 14*a* is composed of a perforated cut line that has incisions at a constant interval, and makes it easy to cut the flaps 34*a* away from the side plate parts 34.

In order to assemble the box body 3 from the pattern paper 10, first, both side plate parts 34 are folded along the creases 11*a* so as to be upright, and then the slat parts 32*a*, 32*b*, 33*a*, and 33*b* are each folded 90 degrees inward along the creases 12*a*, 12*b*, 13*a*, and 13*b*. Then, the edge faces of two adjacent slat parts 32*a* and 32*b* (as well as 33*a* and 33*b*) are positioned so as to face each other, thus forming the front plate part 32 and the back plate part 33. Attaching the flaps 34*b* and 34*c* to the front plate part 32 and back plate part 33, respectively, allows the flaps 34*b* and 34*c* to serve as reinforcing walls that reinforce these plate parts.

Next, a method for storing the product packages 2 in the display and packaging box 1 will now be described. First, the predetermined number of product packages 2 are arranged such that the product accommodating parts 20 project in the same direction, then the product packages 2 are held by a pair of holding members (not shown) with the front parts of the product accommodating parts 20 facing the back surfaces of the adjacent product accommodating parts 20, and the product packages 2 are arranged upright on the bottom plate part 31 of the pattern paper 10 of the box body 3 shown in FIG. 5. Next, similarly, the predetermined number of product packages 2 are arranged such that the product accommodating parts 20 project in the same direction, then the product packages 2 are held by a pair of holding members (not shown) while the front parts of the product accommodating parts 20 face the back surfaces of the adjacent product accommodating parts 20, and the predetermined number of the product packages 2 while being held by the holding members are placed on the product accommodating parts 20 of the product packages 2 that have already been placed upright on the bottom plate part 31 of the pattern paper 10.

Then, after a plurality of product packages 2 are arranged on both the upper and lower levels, both side plate parts 34 are folded along the creases 11*a* so as to be upright, then the slat parts 32*a*, 32*b*, 33*a*, and 33*b* are each folded 90 degrees inward along the creases 12*a*, 12*b*, 13*a*, and 13*b*, and the two adjacent slat parts 32*a* and 32*b* (as well as 33*a* and 33*b*) are adhered with, for example, glue to each other and connected, thus forming the front plate part 32 and the back plate part 33. Then, the holding members are each removed from above, then the flaps 34*b* and 34*c* are placed over and attached to the front plate part 32 and the back plate part 33, and the flaps 34*a* and 34*a* are folded, and the cover 4 is placed over and attached to the flaps 34*a* and 34*a*, the front plate part 32, and the back plate part 33, thus storing the plurality of product packages 2 that have been stacked on both the upper and lower levels in the display and packaging box 1.

Figure 9:
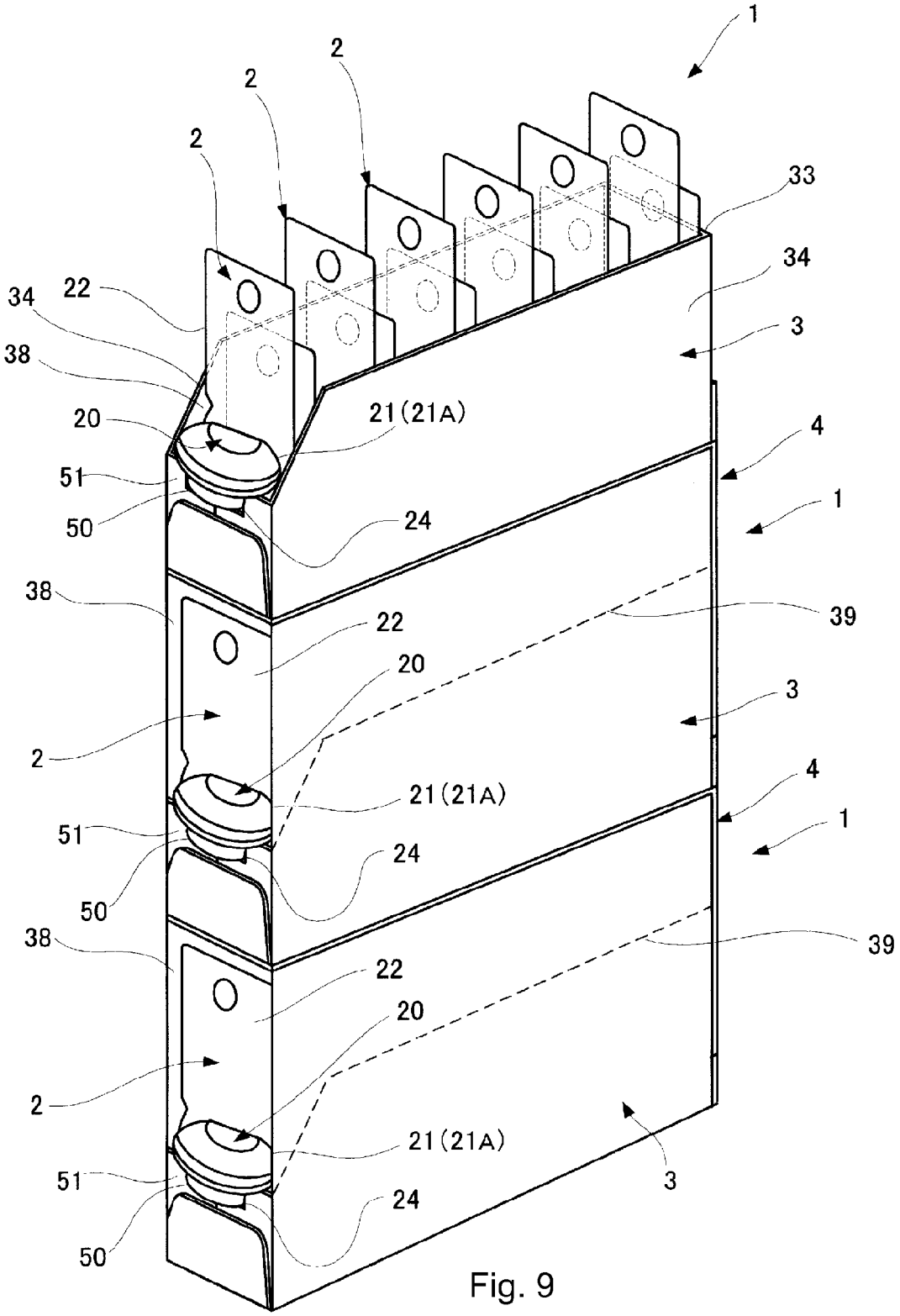
FIG. 9 is an explanatory perspective view showing how display and packaging boxes are used in a stacked manner.

Next, a manner of using this display and packaging box 1 will now be described. Once the display and packaging box 1 is delivered, a plurality of display and packaging boxes 1 are stacked at, for example, the store front as shown in FIG. 9. With regard to the display and packaging box 1 located at the top, the cover 4 is removed, and the front plate part 32 is tear-opened using the tear-opening assisting line 36 and the lateral cut line 37 to open the tear-opening plate parts 53*a* and 53*b*, which are part of the front plate part 32, in a clamshell door-like manner, and the side plate parts 34 and the back plate part 33 are cut along the cut line 39 to detach the upper part of the box body 3 from the box body 3, thus exposing the stored product packages 2 and making it possible to display the product packages 2.

With regard to the display and packaging boxes 1 that are not placed at the top, the side surface parts 41*a* of the cover 4 are opened and cut off, then the front plate part 32 is tear-opened using the tear-opening assisting line 36 and the lateral cut line 37 to open the tear-opening plate parts 53*a* and 53*b* in a clamshell door-like manner, and the tear-opening plate parts

53*a* and 53*b* are removed along the creases 12*a* and 12*b*. Thus, the stored product packages 2 become visible from outside.

After all product packages 2 stored in the display and packaging box 1 at the top are taken out, this display and packaging box 1 is removed, the cover 4 of the display and packaging box 1 thereunder is detached, and the tear-opening plate parts 53*a* and 53*b* of the front plate part 32 are opened and the upper part of the box body 3 is detached, thus making it possible to take out the product packages 2 stored inside this display and packaging box 1.

According to the display and packaging boxes 1 having the above-described configuration, not only the product packages 2 stored in the display and packaging box 1 on the upper most level from which the product packages 2 can be actually taken out are visible from outside but also the product packages 2 stored in the standby display and packaging boxes 1 on the lower levels are visible from outside by tear-opening part of the front plate parts 32, thus giving the customers an eye-catching impression.

Also, the standby display and packaging boxes 1 on the lower levels each have on the upper surface the top panel part 40 of the cover 4 (the flaps 34*a* and 34*a* of the box body 3 in the case where the cover 4 has been removed entirely), and it is thus possible to stack the display and packaging boxes 1 thereon in a stable manner.

Also, because the product packages 2 are stored in an upper and lower double-stack state in the display and packaging box 1, it is possible to reduce unused space inside the packaging box and enhance the product package 2 storing efficiency.

Also, the product package 2 placed on the upper level slides down towards the front along the curved portion 26 of the product accommodating part 20 of the product package 2 placed below when the product package 2 that is located on the lower level and immediately in front is taken out, and falls on the bottom plate part 31 of the box body 3 in a natural manner. In this way, because the product package 2 is placed a little closer to the front in the box body 3, it is also easy to take the product packages 2 stored towards the back out of the box body 3, and it is easy to see the product packages 2 remaining in the box body 3, and thus more effective display of the products can be achieved.

Also, the front-most product package 2 placed on the upper level in the box body 3 exposed when part of the front plate part 32 is tear-opened is prevented from leaning forward by the remaining part 51 of the front plate part 32, and it is thus possible to prevent the product package 2 from falling outward from the opening 38.

Figure 10:
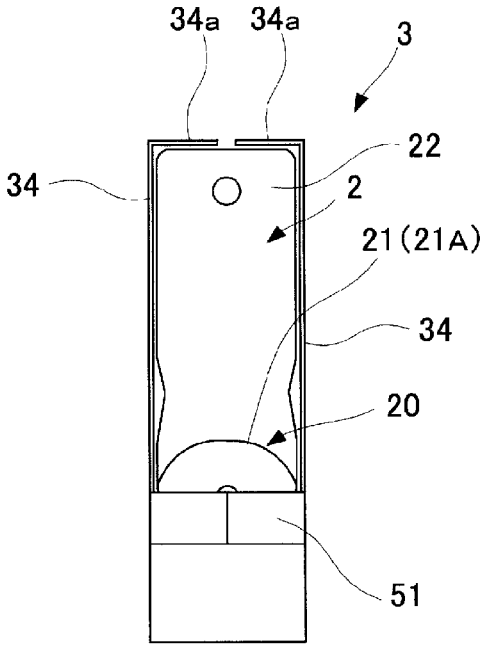
FIG. 10 is a front view showing another embodiment of the display and packaging box.
Figure 11:
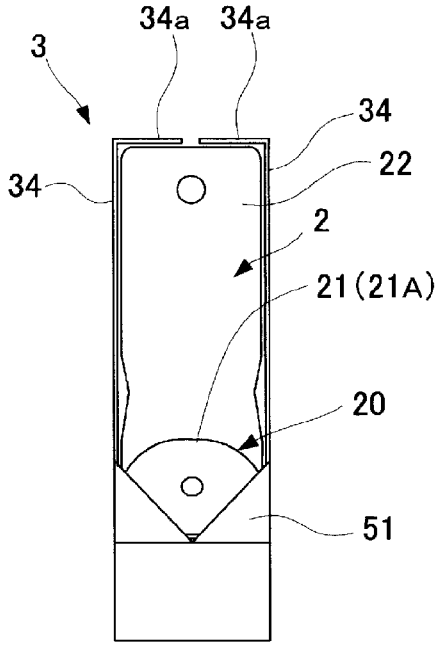
FIG. 11 is a front view showing another embodiment of the display and packaging box.

Although an embodiment of the present invention has been described above, the specific aspect of the present invention is not limited to the above embodiment. For example, in this embodiment with regard to the fall prevention means, the tip of the lower surface (the support piece 24) of the product accommodating part 20 of the front-most product package 2 on the upper level is inserted into and engaged with the U-shaped notch part 50 provided in the remaining part 51 of the front plate part 32 to prevent the product package 2 from falling outward from the opening 38, but the fall prevention means is not necessarily limited thereto, and for example, as shown in FIG. 10, the remaining part 51 of the front plate part 32 may be formed into a linear shape without being provided with the notch part 50 on the upper edge, and the position in terms of height of the upper edge of the remaining part 51 is set such that at least part of the product accommodating part 20 (the lower half in the example shown in the figure) of the front-most product package 2 on the upper level can be supported, and thus the product package 2 is blocked and prevented from falling from the opening 38. Also, as shown in FIG. 11, the fall prevention means may be configured such that the remaining part 51 of the front plate part 32 shown in FIG. 10 is notched into a V shape to support the both right and left sides of the product accommodating part 20.

Figure 12:
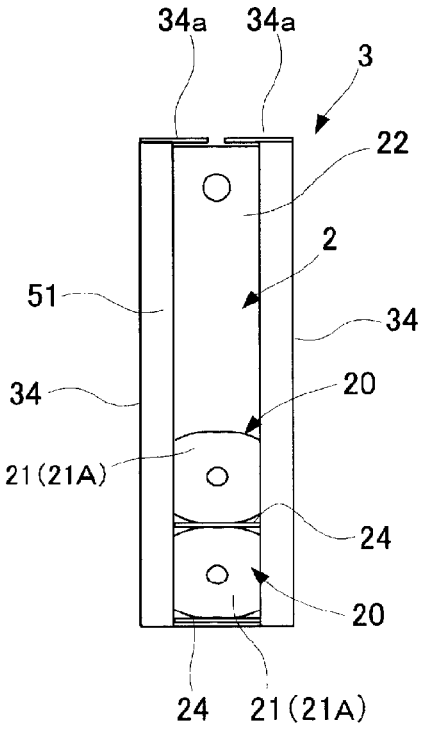
FIG. 12 is a front view showing another embodiment of the display and packaging box.

Also, as shown in FIG. 12, a pair of vertical folding lines 54 that extend in parallel at a predetermined interval from both edges of the front plate part 32, a vertical cut line (not shown) that extends from the upper edge to the lower edge of the front plate part 32 in the substantially central position of both vertical folding lines 54A and 54*b*, and a lateral cut line (not shown) that extends in the lateral direction from the lower edge of the vertical cut line are formed on the front plate part 32. Then, part of the front plate part 32 is tear-opened along the vertical folding lines 54A and 54*b* so as to be separated in a clamshell door-like manner, and a lateral pair of remaining parts 51 of the front plate part 32 are thus formed on the respective side positions of the opening 38. Thereby, both right and left sides of the product accommodating part 20 of the front-most product package 2 on the upper level are supported, and the product package 2 is prevented from falling outward from the opening 38.

Figure 13:
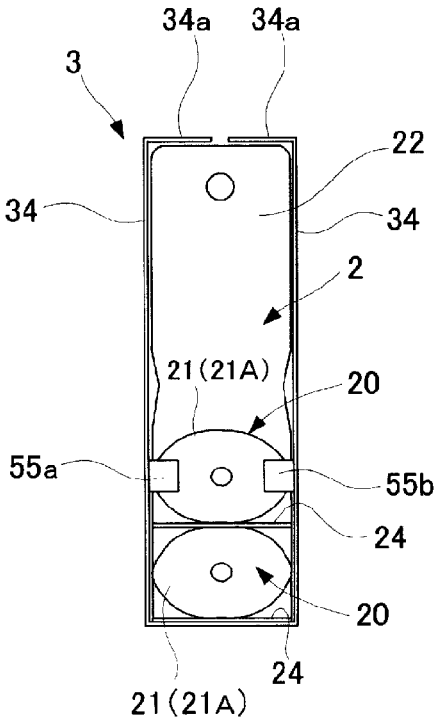
FIG. 13 is a front view showing another embodiment of the display and packaging box.

Also, as shown in FIG. 13, the fall prevention means may be configured such that part of each side plate part 34 is notched so as to be substantially U-shaped to form a pair of support pieces 55*a* and 55*b*, and the support pieces 55*a* and 55*b* are folded towards the opening 38 side and brought into contact with the product accommodating part 20 of the front-most product package 2 on the upper level. Thereby, the product package 2 is supported and prevented from falling from the opening 38.

Figure 14:
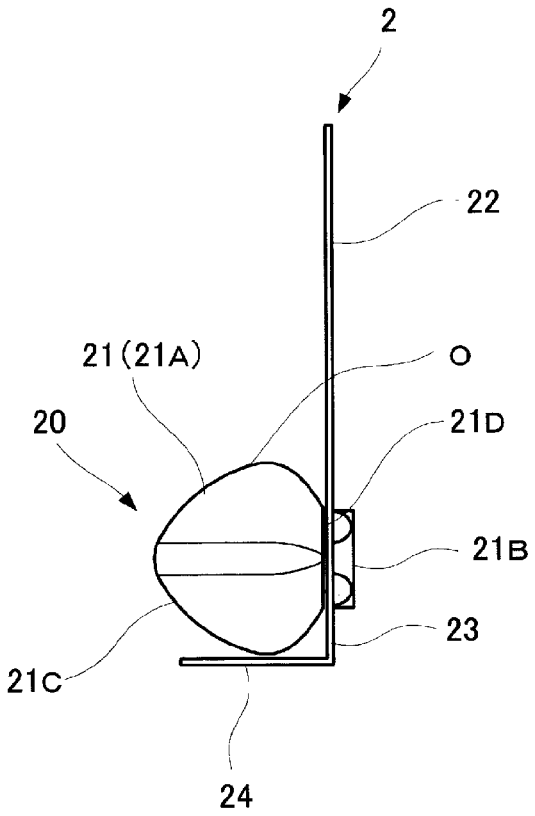
FIG. 14 is a side view showing another embodiment of the product package.

Also, in this embodiment, the flat portion 25 and the curved portion 26 that curves down towards the front from the flat portion 25 are formed in a continuous manner on the upper surface (the upper side surface of the container 2 in this embodiment) of the product accommodating part 20 of each product package 2, but as shown in FIG. 14, the upper surface of the product accommodating part 20 of each product package 2 may be formed into a convex surface. In this embodiment, the product package 2 located on the upper level is arranged on the product accommodating part 20 of the product package 2 located on the lower level such that the position of the centre of gravity thereof is placed more towards the front than an apex O of the convex upper surface of the product accommodating part, and thus the product package 2 placed on the upper level slides towards the front on the product accommodating part 20 of the product package 2 placed on the lower level, and falls on the bottom plate part 32 of the box body 3.

The invention claimed is:

1. A display and packaging box, comprising:

a plurality of product packages each having a header part and a product accommodating part that accommodates a product, and a box body at least having a front plate part and a back plate part that face each other, right and left side plate parts that face each other, a bottom plate part formed in a rectangular shape when viewed from above and configured to support a predetermined number of the plurality of product packages placed upright in a front-back direction, and a storage space configured to store the plurality of product packages, the plurality of product packages being arranged on an upper and a lower level inside the storage space, the lower level formed with the predetermined number of the plurality of product packages, the product accommodating part of each product package on the lower level supporting the product accommodating part of a product package on the upper level, at least part of the front plate part configured to be tear-opened from a remaining part of the front plate part, the tear-opened front plate part configured to form an opening for exposing stored product packages, the opening being provided with a fall preventer part for supporting a front-most product package on the upper level and for preventing the product package from falling from the opening, wherein the product accommodating part of each product package has an upper surface that includes a curved portion that slopes towards a front such that a product package located on the upper level is slidable forward on the product accommodating part of a product package located on the lower level, and the fall preventer part is formed by the remaining part of the front plate part.

2. The display and packaging box according to claim 1, wherein the box body has an opening in an upper surface that is opened and closed by a cover.

3. The display and packaging box according to claim 1, wherein the upper surface of the product accommodating part further includes a flat portion, the flat portion being continuous with the portion that slopes towards the front, and the product package on the upper level is arranged on the product accommodating part of the product package on the lower level such that a centre of gravity thereof is placed closer to the front than a central position of the flat portion.

4. The display and packaging box according to claim 1, wherein the remaining part of the front plate part is formed by separating a predetermined region below an upper edge of the front plate part.

5. The display and packaging box according to claim 4, wherein a notch part shaped to receive a tip part of a lower surface of the product accommodating part of the front-most product package on the upper level is formed on an upper edge of the remaining part of the front plate part.

* * * * *